US010946642B2

(12) United States Patent
Tsuchihashi et al.

(10) Patent No.: US 10,946,642 B2
(45) Date of Patent: Mar. 16, 2021

(54) LIQUID EJECTING APPARATUS AND DRIVING METHOD FOR LIQUID EJECTING APPARATUS

(71) Applicant: SEIKO EPSON CORPORATION, Tokyo (JP)

(72) Inventors: Ryosuke Tsuchihashi, Matsumoto (JP); Masashi Kamibayashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 10 days.

(21) Appl. No.: 16/362,371

(22) Filed: Mar. 22, 2019

(65) Prior Publication Data

US 2019/0291412 A1 Sep. 26, 2019

(30) Foreign Application Priority Data

Mar. 23, 2018 (JP) ..... JP2018-055766

(51) Int. Cl.
*B41J 2/045* (2006.01)

(52) U.S. Cl.
CPC ..... *B41J 2/0451* (2013.01); *B41J 2/04586* (2013.01)

(58) Field of Classification Search
CPC ..... B41J 2/0451; B41J 2/04586; B41J 2/175; B41J 2/195; B41J 29/393; H04K 1/00; H04L 9/32
See application file for complete search history.

(56) References Cited

U.S. PATENT DOCUMENTS 7,123,367 B1 10/2006 Kanaya et al.
7,128,408 B2 * 10/2006 Kosugi ..... B41J 2/1752 347/86
7,212,637 B2 * 5/2007 Salisbury ..... B41J 2/17546 380/270
7,267,420 B2 * 9/2007 Yagi ..... B41J 2/0451 347/12

FOREIGN PATENT DOCUMENTS

JP 06-320732 A 11/1994
JP 2002-029045 A 1/2002
JP 2003-136704 A 5/2003
JP 2006-297731 A 11/2006

* cited by examiner

*Primary Examiner* — Thinh H Nguyen
(74) *Attorney, Agent, or Firm* — Workman Nydegger

(57) ABSTRACT

A liquid ejecting apparatus comprises a liquid ejecting head ejecting liquid, an identification information acquisition device configured to acquire identification information from the liquid ejecting head, a storage device in which the identification information is stored, and a control device configured to, in a case in which, when a replacement for the liquid ejecting head is made, the liquid ejecting head being a replacement target has been attached again, notify that the liquid ejecting head being the replacement target is in an attached state again, based on the identification information stored in the storage device.

17 Claims, 7 Drawing Sheets

| ID | USAGE HISTORY (H) | MALFUNCTION HISTORY |
|---|---|---|
| 01 | 5000 | PIEZOELECTRIC ELEMENTS' DETERIORATIONS |
| 02 | 900 | MULTIPLE NOZZLE OMISSIONS |
| 03 | 3000 | |
| 04 | 2800 | |
| 05 | 3500 | |
| 06 | 3200 | |
| 07 | 2500 | |
| 08 | 4500 | |
| 09 | 4000 | MULTIPLE NOZZLE OMISSIONS |
| 10 | 3800 | |

LIQUID EJECTING APPARATUS AND DRIVING METHOD FOR LIQUID EJECTING APPARATUS

BACKGROUND

1. Technical Field

The present invention relates to a liquid ejecting apparatus including a liquid ejecting head that ejects liquid through nozzles, and to a driving method for a liquid ejecting apparatus.

2. Related Art

A liquid ejecting apparatus is an apparatus that includes a liquid ejecting head capable of allowing liquid to be ejected as liquid droplets through nozzles, and that ejects various kinds of liquid from this liquid ejecting head. As an exemplar of such a liquid ejecting apparatus, there can be exemplified an image recording apparatus, such as an ink jet recording apparatus (printer) including an ink jet recording head and performing recording of images and the like by allowing ink in a liquid condition to be ejected as ink droplets through nozzles of the ink jet recording head. Further, in addition thereto, the liquid ejecting apparatus is used for ejecting various kinds of liquid, such as organic materials for use in an organic electro luminescence (EL) display, color materials for use in color filters for a liquid crystal display and the like, and electrode materials for use in forming electrodes, and the like. Further, in a recording head for the image recording apparatus, inks being in a liquid condition are ejected, and in a color material ejecting head for a display manufacturing apparatus, solutions of individual red (R), green (G), and blue (B) color materials are ejected. Further, in an electrode material ejecting head for an electrode forming apparatus, electrode materials being in a liquid condition are ejected, and in a live organic material ejecting head for a chip manufacturing apparatus, solutions of live organic materials are ejected.

Among the above-described liquid ejecting apparatuses, there exists a liquid ejecting apparatus including a plurality of liquid ejecting heads. Each of the liquid ejecting heads is unitized so as to be replaceable upon occurrence of a malfunction or the like, and is attached so as to be attachable/detachable to/from the liquid ejecting apparatus. Further, among the liquid ejecting heads, there exists a kind of liquid ejecting head in which liquid ejecting heads are provided with, for each of the liquid ejecting heads, identification information in which the property of the each liquid ejecting head is recorded (see JP-A-2003-136704). A liquid ejecting apparatus reads the identification information for a liquid ejecting head having been attached to the liquid ejecting apparatus, and performs driving in a way appropriate to the property of the relevant liquid ejecting head.

By the way, when a liquid ejecting head being in a state of being attached to the liquid ejecting apparatus is necessary to be replaced due to a malfunction or the like, after the detachment of the liquid ejecting head from the liquid ejecting apparatus, the detached liquid ejecting head is likely to be attached to the liquid ejecting apparatus again due to work error or the like. In order to reduce such a defect, a structure that allows the liquid ejecting head to record therein information, such as a malfunction and the like, that is, for example, a structure that allows the liquid ejecting head to include a non-volatile memory or the like, can be considered, but such a structure is likely to complicate the structure of the liquid ejecting head and increase the manufacturing cost.

SUMMARY

An advantage of some aspects of the invention is that a liquid ejecting apparatus and a driving method for a liquid ejecting apparatus are provided that enable reduction of the occurrence of a situation where a liquid ejecting head having been detached once is erroneously attached to the liquid ejecting apparatus again.

According to an aspect of the invention, a liquid ejecting apparatus includes at least one liquid ejecting head including nozzles through which liquid is ejected, and including at least one piece of identification information specific to the at least one liquid ejecting head, an identification information acquisition device configured to acquire the at least one piece of identification information from the at least one liquid ejecting head, a storage device in which the at least one piece of identification information is stored, and a control device configured to, in a case in which, when a replacement for the at least one liquid ejecting head is made, a liquid ejecting head being among the at least one liquid ejecting head and being a replacement target has been attached again, notify that the liquid ejecting head being the replacement target is in an attached state again, based on the at least one piece of identification information stored in the storage device.

This configuration enables reduction of the occurrence of a situation where a liquid ejecting head having been detached once due to, for example, deterioration, a malfunction, or the like is erroneously attached to the liquid ejecting apparatus again. As a result, the occurrence of a situation where the printing operation is performed using a liquid ejecting head being in a deteriorated state, a malfunction state, or any other similar state can be reduced, and thus, the degradation of the image quality of printed objects can be reduced. Here, it should be noted that the term "notify" used herein includes not only the case where the notification is made in a way that enables perceptions by human-beings, but also the case where an electric signal in relation to the notification is transmitted. That is, the case where an electric signal in relation to the notification is transmitted to an external device and the external device makes a notification in a way that enables perceptions by human-beings based on the electric signal is also included in the term "notify" in the invention.

In the above configuration, it is preferable that the control device allows the storage device to store a piece of identification information being among the at least one piece of identification information and being specific to the liquid ejecting head being the replacement target, as a piece of replacement target identification information; allows the storage device to store the at least one piece of identification information being specific to the at least one liquid ejecting head being in an attached state after a replacement, as at least one piece of post-replacement identification information; and notifies that the liquid ejecting head being the replacement target is in an attached state again, when the piece of replacement target identification information exists among the at least one post-replacement identification information.

In the above configuration, it is preferable that the control device allows the storage device to store a piece of identification information being among the at least one piece of identification information and being specific to a liquid ejecting head being among the at least one liquid ejecting head and having been designated as a replacement target by a user, as the piece of replacement target identification information.

This configuration enables reduction of the occurrence of a situation where, even when a user optionally replaces a liquid ejecting head, a liquid ejecting head having been detached from the liquid ejecting apparatus is erroneously attached to the liquid ejecting apparatus again.

Further, in any one of the above configurations, it is preferable that the liquid ejecting apparatus further includes a detection device configured to detect a malfunction in the at least one liquid ejecting head, and when the detection device has detected a malfunction of a liquid ejecting head among the at least one liquid ejecting head, the control device allows the storage device to store a piece of identification information being among the at least one piece of identification information and being specific to the liquid ejecting head, for which the malfunction has been detected, as the piece of replacement target identification information.

Moreover, in the above configuration, it is preferable that the liquid ejecting apparatus further includes a detection device configured to detect a malfunction in the at least one liquid ejecting head; when the detection device has detected a malfunction of a liquid ejecting head among the at least one liquid ejecting head, the control device allows the storage device to store a piece of malfunction information in relation to the malfunction together with a piece of identification being among the at least one piece of identification information and being specific to the liquid ejecting head, for which the malfunction has been detected; and in a case in which, when a replacement for the at least one liquid ejecting head is made, a liquid ejecting head being among the at least one liquid ejecting head and having a piece of identification information coinciding with a piece of identification information being among the at least one piece of identification information and stored, together with the piece of malfunction information, in the storage device is in an attached state, the control device notifies that the liquid ejecting head having a malfunction history is in an attached state, based on the piece of malfunction information, which is stored, together with the piece of identification information, in the storage device.

These configurations enable reduction of the occurrence of a situation where a liquid ejecting head for which a malfunction has been detected is erroneously attached to the liquid ejecting apparatus.

Further, in the above configuration, it is preferable that, after power-on of the at least one liquid ejecting head, the control device acquires the at least one piece of identification information specific to the at least one liquid ejecting head being in a attached state; determines whether or not the piece of malfunction information is stored in the storage device together with a piece of identification information being among the at least one piece of identification information and specific to a liquid ejecting head among the at least one liquid ejecting head; and when the piece of malfunction information associated with the liquid ejecting head is stored in the storage device, the control device notifies that the liquid ejecting head having a malfunction is in an attached state.

This configuration enables reduction of the occurrence of a situation where a liquid ejecting head having previously malfunctioned is erroneously attached to the liquid ejecting apparatus again.

Moreover, in the above configuration, it is preferable that, in a case in which, when a replacement for the at least one liquid ejecting head is made, a liquid ejecting head being among the at least one liquid ejecting head and having a piece of identification information not coinciding with any of the at least one piece of identification information stored in the storage device is in an attached state, the control device allows the storage device to newly store a piece of usage history information associated with the liquid ejecting head together with the piece of identification information.

This configuration also enables driving signals for the liquid ejecting head having been newly attached to the liquid ejecting apparatus to be corrected using the piece of usage history information having been stored into the storage device. Further, this correction of the driving signals using the piece of usage history information enables the liquid to be ejected in a way appropriate to the usage history of the liquid ejecting head.

Moreover, in the above configuration, it is preferable that, in a case in which, when a replacement for the at least one liquid ejecting head is made, a liquid ejecting head other than the liquid ejecting head being the replacement target is in a detached state, the control device notifies that the liquid ejecting head other than the liquid ejecting head being the replacement target is in a detached state, based on the at least one piece of identification information stored in the storage device.

This configuration enables a user to recognize the replacement of a liquid ejecting head, which has not been intended by the user.

Further, according to another aspect of the invention, a driving method for a liquid ejecting apparatus provided with at least one liquid ejecting head including nozzles through which liquid is ejected, and at least one piece of identification information specific to the at least one liquid ejecting head includes, before a replacement for the at least one liquid ejecting head, storing a piece of identification information being among the at least one piece of identification information and having been acquired from a replacement target liquid ejecting head among the at least one liquid ejecting head, as a piece of replacement target identification information; after the replacement for the at least one liquid ejecting head, storing the at least one piece of identification information having been acquired from the at least one liquid ejecting head being in an attached state after the replacement, as at least one piece of post-replacement identification information; and when the piece of replacement target identification information is included in the at least one piece of post-replacement identification information, notifying that the liquid ejecting head being the replacement target is in an attached state again.

This method enables reduction of the occurrence of a situation where a liquid ejecting head having been detached once due to, for example, deterioration, a malfunction, or the like is erroneously attached to the liquid ejecting apparatus again. As a result, the occurrence of a situation where the printing operation is performed using a liquid ejecting head being in a deteriorated state, a malfunction state, or any other similar state can be reduced, and thus, the degradation of the image quality of printed objects can be reduced.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment to practice the invention will be described with reference to the accompanying drawings. It should be noted that the embodiment described below includes various limitations as appropriate specific examples of the invention, but the scope of the invention is not limited to the embodiment described below unless, in the following description, there particularly exists any description stating the limitation of the invention. Further, in the following description, as the liquid ejecting apparatus according to the invention, an ink jet recording apparatus (hereinafter referred to as a printer) 1 will be exemplified and described.

Figure 1:
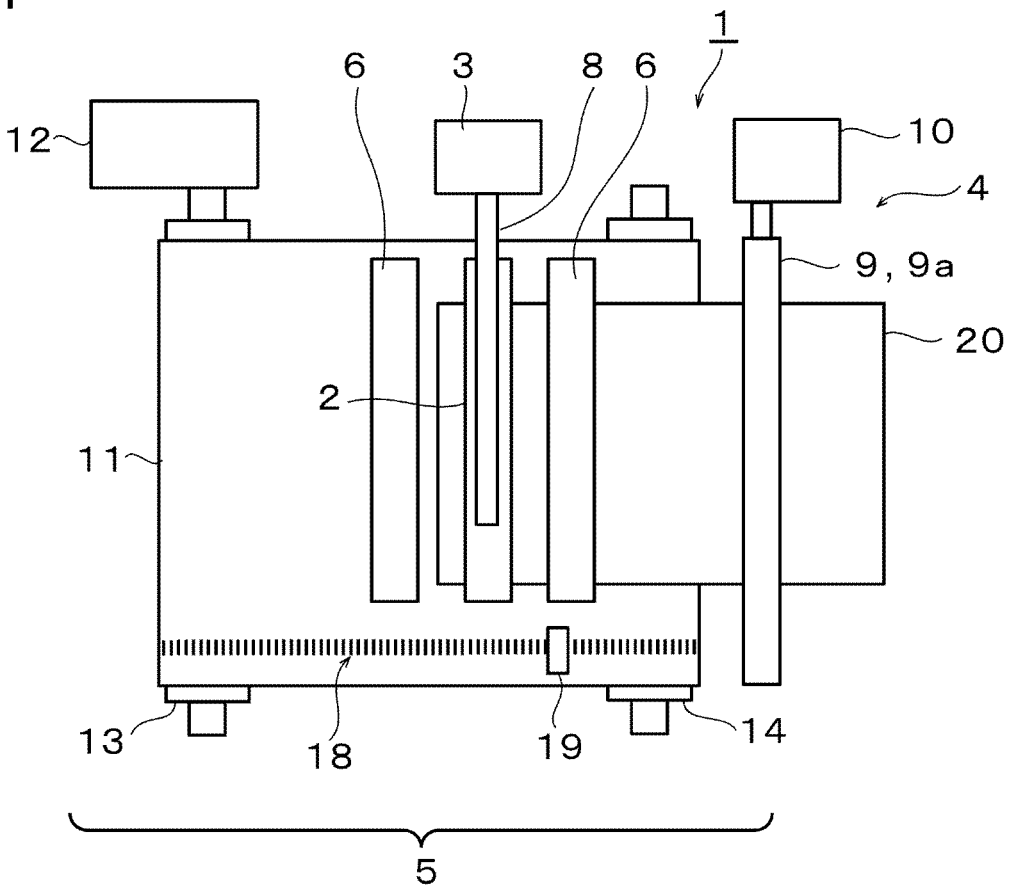
FIG. 1 is a plan view of a printer, illustrating a configuration of the printer.
Figure 2:
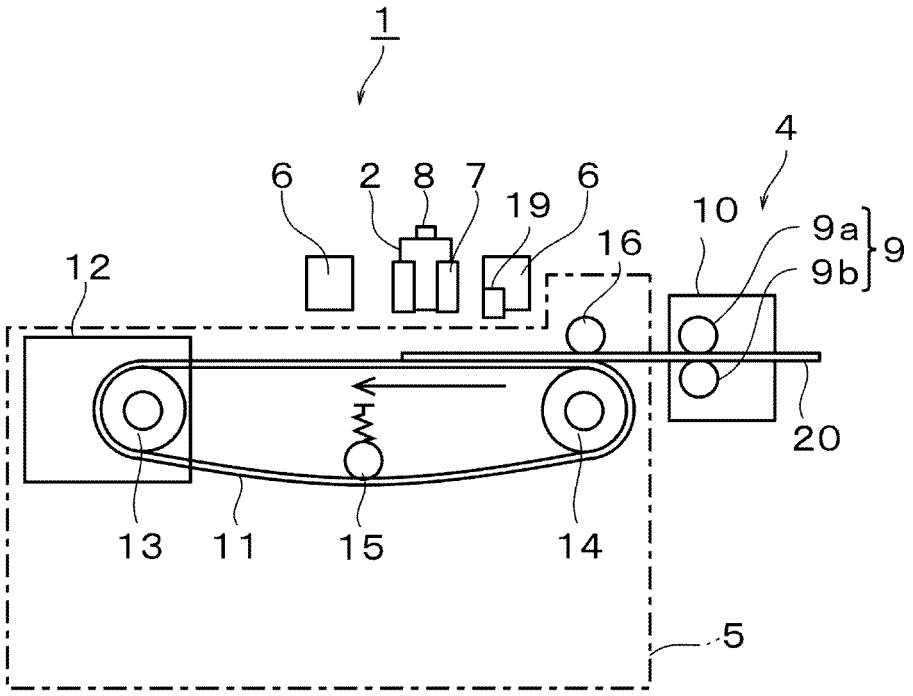
FIG. 2 is a side view of the printer, illustrating a configuration of the printer.

FIG. 1 is a plan view of the printer 1, schematically illustrating the configuration of the printer 1, and FIG. 2 is a side view of the printer 1, schematically illustrating the configuration of the printer 1. The printer 1 includes a recording head 2, an ink tank 3, a paper feeding mechanism 4, a transporting mechanism 5, ID acquisition devices 6 (corresponding to an identification information acquisition device in the invention), and the like. The recording head 2 is a device in which a plurality of ejecting units 7, namely, ejecting units that perform recording of images and the like by ejecting ink as a kind of liquid, are arranged along a paper width direction of recording paper 20 (that is, a direction perpendicular to a transport direction in which the recording paper 20 is transported). Here, the ejecting unit 7 corresponds to a liquid ejecting head in the invention, and the recording paper 20 is a recording medium or a kind of ink-droplet landing target. The ID acquisition devices 6 are devices for reading (in other words, acquiring) an ID (a kind of identification information) formed by a bar cord, a QR cord (trademark), or the like that is attached on each of the ejecting units 7. The ID acquisition devices 6 in the present embodiment include sensors for optically reading the ID, and are disposed on the both sides of the recording head 2 in the transport direction of the recording paper 20. The ink tank 3 is a kind of liquid supply source in which ink supplied to the recording head 2 is stored. The ink inside the ink tank 3 is supplied to the recording head 2 via a liquid supply tube 8. Here, a configuration in which a liquid supply source is mounted above the recording head 2 can be also employed. The configuration of the recording head 2 will be described later.

The paper feeding mechanism 4 includes a paper feeding roller 9 and a paper feeding motor 10, and is disposed further upstream than the transporting mechanism 5. The paper feeding roller 9 is constituted by a pair of an upper side roller 9*a* and a lower side roller 9*b*. The upper side roller 9*a* and the lower side roller 9*b* are synchronously rotatable in mutually opposite directions in a state of pinching the recording paper 20 having been fed from an unillustrated paper feeding portion. Further, the paper feeding roller 9 is driven by the power from the paper feeding motor 10; corrects the skew of the recording paper 20 relative to the transport direction of the recording paper 20 in cooperation with an unillustrated skew correction roller; corrects the displacement of the recording paper 20 in both directions perpendicular to the transport direction (namely, both paper width directions of the recording paper 20); and then, supplies the recording paper 20 having been subjected to the corrections to the side of the transporting mechanism 5.

The transporting mechanism 5 includes a transport belt 11, a transport motor 12, a driving roller 13, a driven roller 14, a tension roller 15, and a pressure contact roller 16. The transport motor 12 is a driving source of the transporting mechanism 5, and is a mechanism for transmitting the power to the driving roller 13. The transport belt 11 is an endless shaped belt, and is provided in a tensioned state between the driving roller 13 and the driven roller 14. The tension roller 15 is a roller that is in contact with the inner circumference face of the transport belt 11 at a position between the driving roller 13 and the driven roller 14 so as to apply tension to the transport belt 11 by means of an energizing force of an energizing member, such as a spring or the like. The pressure contact roller 16 is a roller that is disposed immediately above the driven roller 14 in a state of interposing the transport belt 11 between the pressure contact roller 16 and the driven roller 14 to depress the recording paper 20 toward the side of the transport belt 11.

On the outer circumference face of the transport belt 11, a linear scale 18 is disposed across the entire circumference. This linear scale 18 is a slit-shaped detection pattern. This slit-shaped detection pattern includes a plurality of slit-shaped scales each arranged at a predetermined pitch (for example, 360 dpi) in the transport direction of the transport belt 11. The detection pattern of the linear scale 18 is optically detected by a detection head 19, and detection signals are output to a control device 26 (see FIG. 3) of the printer 1 as encoder signals. Thus, the control device 26 is capable of acquiring the amount of transport of the recording paper 20 transported by the transporting mechanism 5 (the transport belt 11) based on the encoder signal. Further, the encoder signal is a signal based on which the timing points of the occurrences of driving signals for driving unillustrated actuators inside the ejecting unit 7 (which are piezoelectric elements in the present embodiment) are determined.

Figure 3:
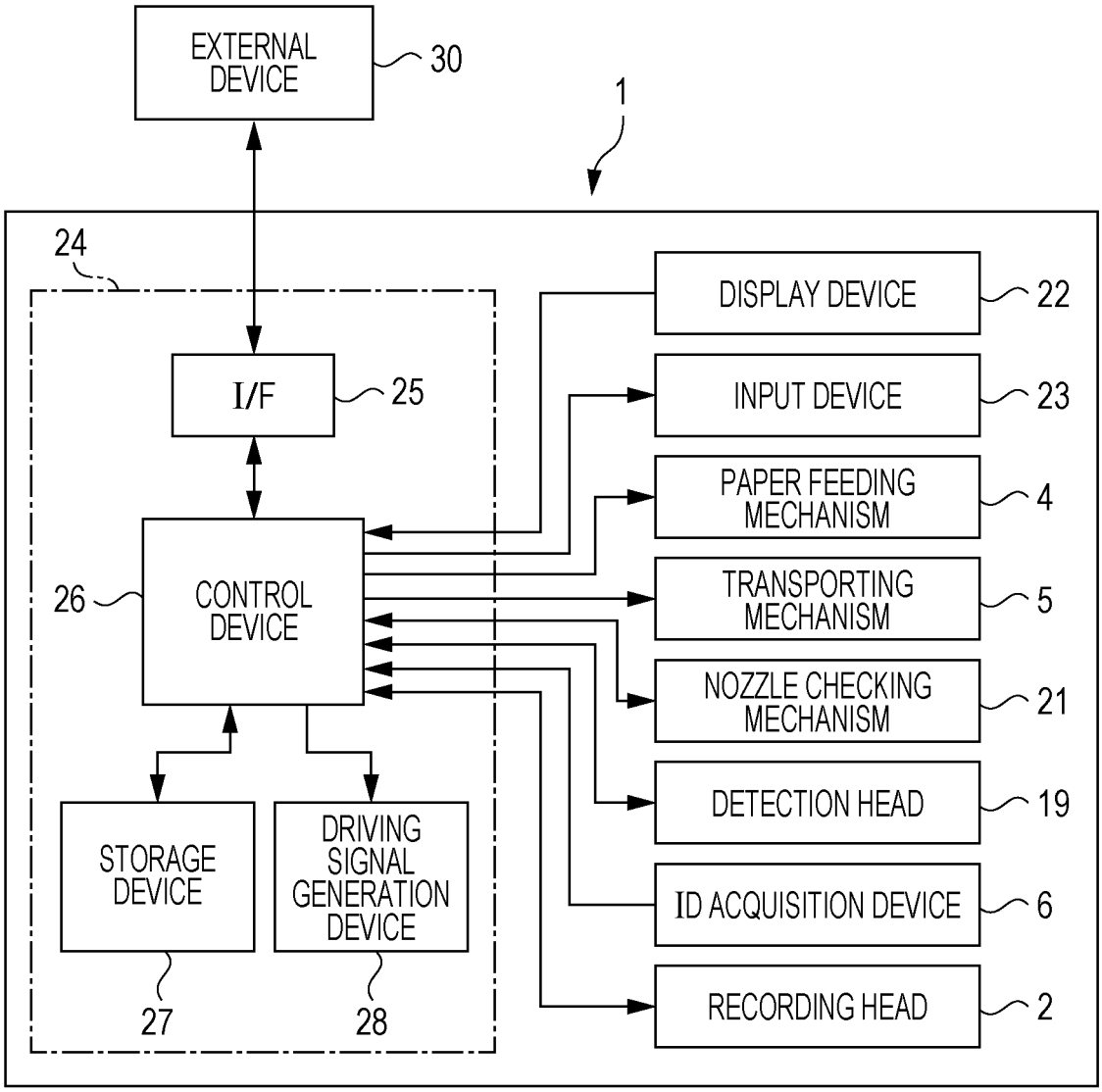
FIG. 3 is a block diagram illustrating an electric configuration of the printer.

Next, the electric configuration of the printer 1 will be described. FIG. 3 is a block diagram illustrating the electric configuration of the printer 1. The printer 1 in the present embodiment includes a display device 22, an input device 23, the paper feeding mechanism 4, the transporting mechanism 5, a nozzle checking mechanism 21, the detection head 19, the ID acquisition devices 6, the recording head 2, and a printer controller 24, namely, a printer controller for controlling these components.

The printer controller 24 in the present embodiment includes an interface (I/F) portion 25, a control device 26 (a kind of control device in the invention), a storage device 27, and a driving signal generation device 28. The interface portion 25 receives printing data, information indicating the size (width) of the recording paper 20, printing instructions, and the like, from an external device 30, namely, an external device, such as a computer, a portable information terminal device, or the like, and outputs information indicating the status of the printer 1 to the side of the external device 30. The storage device 27 is an element for storing therein programs for the control device 26, data for use in various kinds of control, and information in relation to the individual ejecting units 7, such as IDs, usage histories, and the like, and includes a ROM module, a RAM module, and an NVRAM (non-volatile memory element) module. The driving signal generation device 28 generates driving signals for use in ejecting ink droplets onto the recording paper 20 to thereby record images and the like.

The control device 26 generates ejection data indicating at which timing point which size of an ink droplet (liquid droplet) is to be ejected through which of nozzles of the recording head 2 at the time of the execution of printing operation, based on the printing data having been received from the external device 30, and transmit the ejection data to the recording head 2. Further, the control device 26 generates timing signals (timing pulses) based on the encoder signals (encoder pulses) output from the detection head 19. The driving signal generation device 28 outputs driving signals COM based on the timing signals. The driving signal generation device 28 generates analog voltage signals based on waveform data in relation to the waveforms of the driving signals, and generates the driving signals COM by amplifying the analog voltage signals by means of an unillustrated amplifier circuit. The driving signals COM having been generated by the driving signal generation device 28 are transmitted to the recording head 2. Moreover, at the time of the replacement of an ejecting unit 7, in order to specify a detached ejecting unit 7 and an attached ejecting unit 7, the control device 26 in the present embodiment performs ID comparison processing and any other processing on three kinds of IDs having been acquired by the ID acquisition devices 6, a first one of the three kinds of IDs being the ID of a replacement target ejecting unit 7 (this ID being also referred to as a replacement target ID or replacement target identification information hereinafter), a second one of the three kinds of IDs being the IDs of ejecting units 7 having been in a state of being attached to the recording head 2 before the replacement (each of these IDs being also referred to as a pre-replacement ID or pre-replacement identification information hereinafter), a third one of the three kinds of IDs being the IDs of ejecting units 7 being in a state of being attached to the recording head 2 after the replacement (each of these IDs being also referred to as a post-replacement ID or post-replacement identification information hereinafter). In addition thereto, the control device 26 determines whether or not each of the ejecting units 7 is to be replaced, based on the number of defective nozzles having been detected by the nozzle checking mechanism 21, a usage time (or a voltage application time) of the each ejecting unit 7, and the like. That is, in the present embodiment, the control device 26 also functions as a detection device for detecting the malfunctions of the ejecting units 7.

The nozzle checking mechanism 21 is a mechanism for detecting a defective nozzle through which the ink is not normally ejected. The nozzle checking mechanism 21 includes, for example, a vibration detection circuit for detecting a counter electromotive force signal of each of the piezoelectric elements based on a pressure vibration (a residual vibration) that occurs in ink inside a corresponding one of pressure chambers (not illustrated) of each of the ejecting unit 7; a determination circuit for determining a malfunction of ink ejection of each of the nozzles of the each ejecting unit 7 based on the counter electromotive force signal (the above circuits being not illustrated); and any other circuit. Here, in the case of the defective nozzle, through which the ink is not normally ejected, a pressure vibration that occurs in ink inside each of the pressure chambers after a corresponding one of the piezoelectric elements has been driven is different from that in the case of a normal nozzle when compared with that. That is, in the case of the defective nozzle, the counter electromotive force signal detected by the vibration detection circuit is different from that in the case of the normal nozzle when compared with that, and thus, the defective nozzle can be detected. A check result resulting from the checking by the nozzle checking mechanism 21 is transmitted to the control device 26. Further, the control device 26 counts the number of the defective nozzles, and the like, based on the transmitted check result. Note that any one or both of the vibration detection circuit and the determination circuit can be integrated into the control device 26 as a portion of the control device 26. Further, the configuration of the nozzle checking mechanism 21 is not limited to the above-described configuration, and various configurations can be employed as the configuration of the nozzle checking mechanism 21. For example, there can be employed a mechanism that allows a defective nozzle to be detected in such a way that an electric field is formed between a nozzle face 31 and a detection face facing the nozzle face 31, and a temporal voltage-value change on the detection face based on a electrostatic induction that occurs at the time when ink flies from a nozzle toward the detection face is detected. Moreover, there can be also employed a mechanism that allows a defective nozzle to be detected in such a way that a camera for photographing ink ejected from a nozzle is provided, and the defective nozzle is detected based on an ink flight image having been photographed by the camera. Furthermore, there can be also employed a mechanism that allows a defective nozzle to be detected in such a way that a test pattern is actually printed on the recording paper 20 or the like, and the defective nozzle is detected from the result of the printing.

The display device 22 is a display device attached to the printer 1, such as a crystal liquid display or the like. Various kinds of information, such as a status of the printer 1, a remaining amount of the ink inside the ink tank 3, and the like, are displayed on the display device 22. The input device 23 is constituted by, for example, operation buttons, a touch panel attached on the surface of a liquid crystal display, and the like, and outputs operation signals to the control device 26 upon receipt of operations of a user. Further, the control device 26 performs various kinds of control and operation based on the operation signals. Note that various kinds of information can be also displayed on a display portion of the external device 30, and various kinds of operation can be also performed based on operation signals from the external device 30. In this case, there can be also employed a configuration in which the display device 22 and the input device 23 are not provided in the printer 1.

Figure 4:
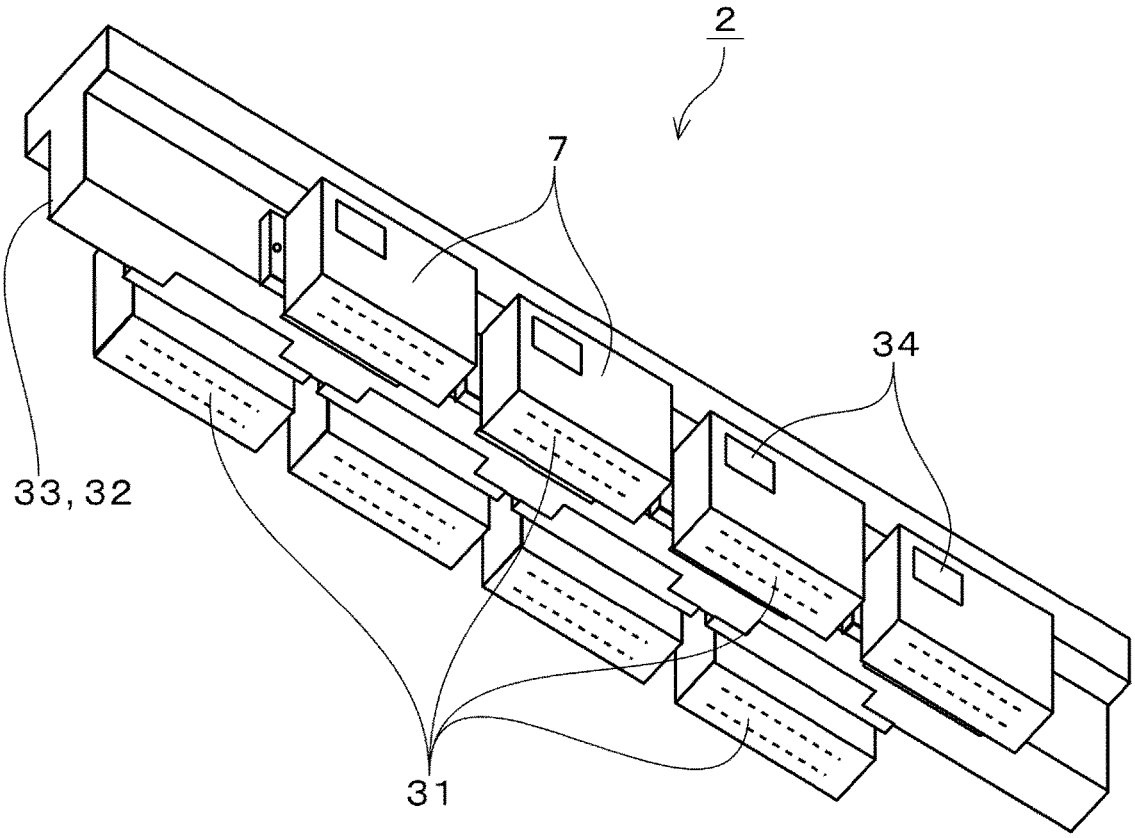
FIG. 4 is a perspective view of a recording head, seen from a bottom face side.
Figure 5:
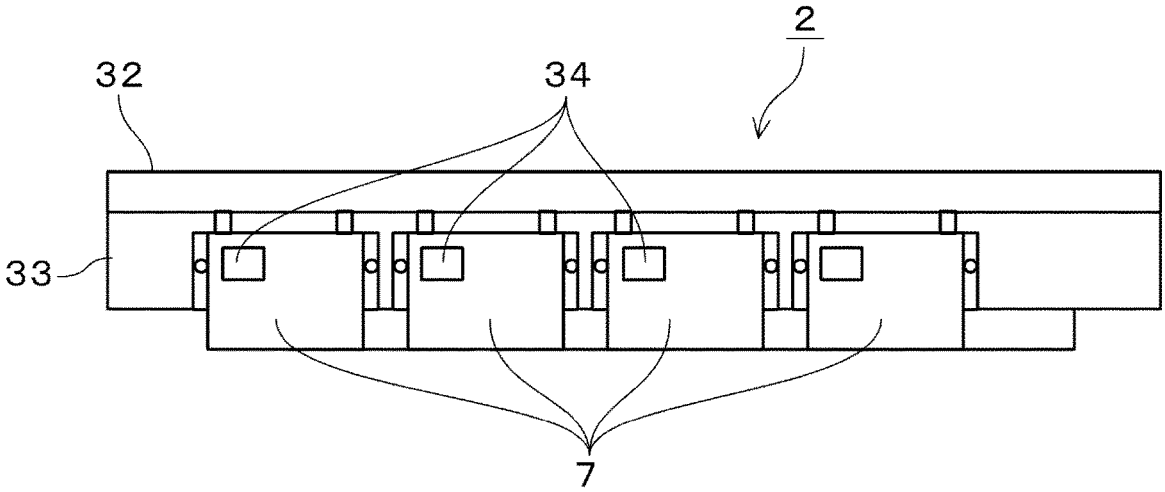
FIG. 5 is a front view of the recording head, illustrating a configuration of the recording head.

Next, the configuration of the recording head 2 will be described using FIGS. 4 and 5. FIG. 4 is a perspective view of the recording head 2, seen from the side of the nozzle face 31, and FIG. 5 is a plan view of the recording head 2. The recording head 2 in the present embodiment includes rows of ejecting units 7, each of the rows including four ejecting units 7 and being attached on a corresponding one of the both side faces of a base plate 32 in the transport direction of the recording paper 20. That is, a total of eight ejecting heads 7 are attached to the recording head 2.

The base plate 32 is a supporting member that is made of SUS (stainless steel) or the like, and that is long in a direction in which the ejecting units 7 are arranged. The lower portion of the base plate 32 is a unit attachment portion 33, namely, a unit attachment portion extending downwardly and having a plate shape. The four ejecting units 7 are attached to each of the front face and the back face of the unit attachment portion 33. The ejecting units 7 are attachably and detachably secured using, for example, screws or the like in a state of being aligned against the base plate 32. Note that, in the present embodiment, a row of ejecting units 7 on the side of the front face of the unit attachment portion 33 and another row of ejecting units 7 on the side of the rear face of the unit attachment portion 33 are arranged in such a way as to be mutually displaced by half a pitch at which each of the ejecting units 7 is arranged.

The ejecting unit 7 includes nozzles each having an opening on the nozzle face 31, pressure chambers each communicating with a corresponding one of the nozzles, actuators (for example, piezoelectric elements) each causing a pressure variation to arise in ink inside a corresponding one of the pressure chambers, ink flow paths for supplying the ink to the pressure chambers (these components being not illustrated), and any other component. Further, upon supply of a driving signal from the printer controller 24, a corresponding actuator is driven, thereby allowing an ink droplet to be ejected (in other words, discharged) through a corresponding nozzle, or allowing a slight vibration to arise inside a corresponding pressure chamber to a degree that does not allow any ink droplet to be ejected. Further, an ID label 34 is bonded on a side face of each of the ejecting units 7, and an ID is printed on the ID label 34. The ID label 34 is exposed at a position facing the sensor of each of the ID acquisition devices 6 in such a way as to be readable by the ID acquisition devices 6. Here, the ID recorded on the ID label 34 corresponds to rows of characters composed of letters, numerals, symbols, and the like and including manufacturing date, a lot number, and the like. The ID corresponds to identification information that is specific to and different for each of the ejecting units 7.

Further, the printer 1 configured in such a way as described above is configured to enable reduction of a situation where a replacement target ejecting unit 7 (a liquid ejecting head) having been detached once at the time of the replacement of the ejecting unit 7 is erroneously attached to the printer 1 again. The detailed description about this respect will be made later.

Figure 6:
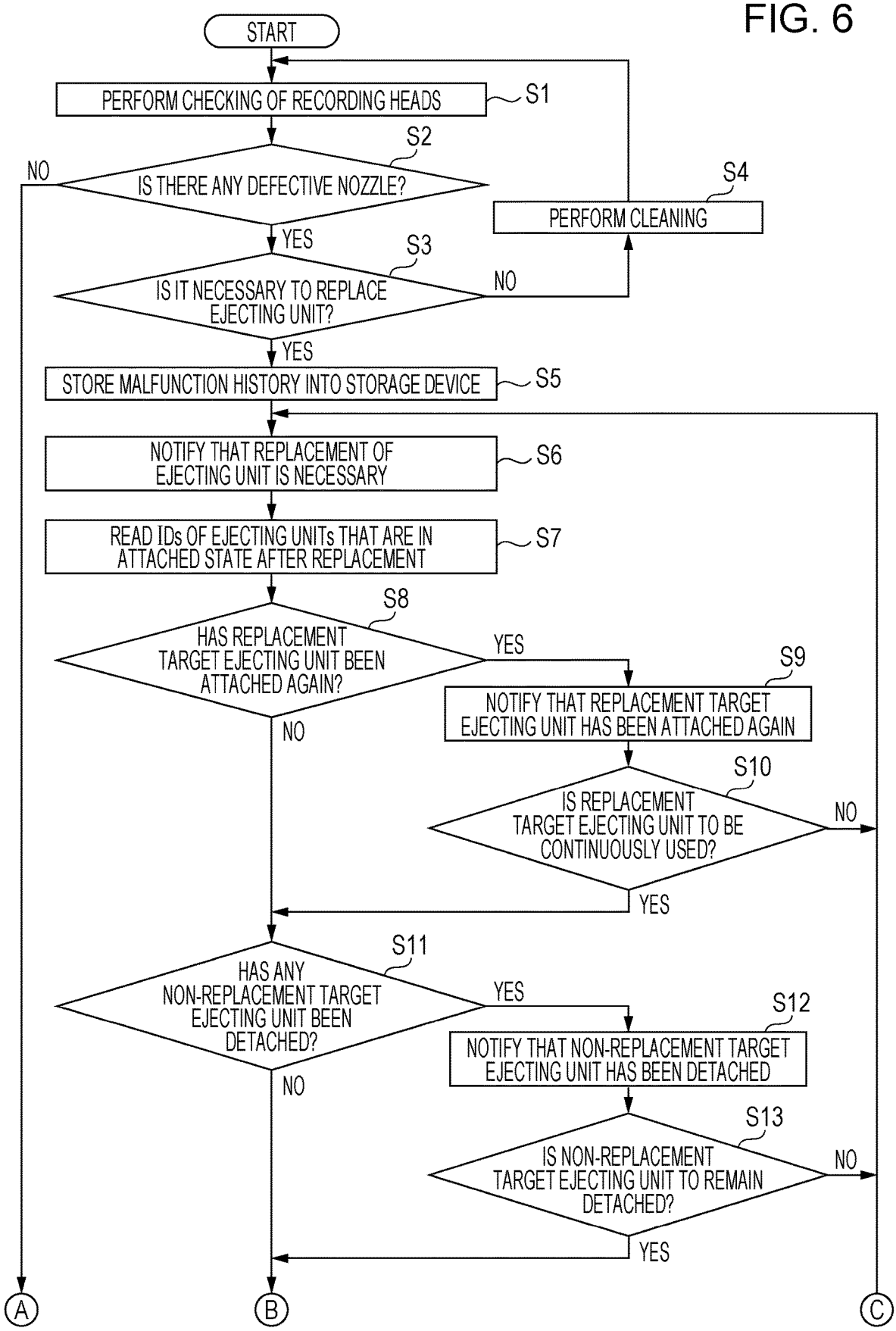
FIG. 6 is a flowchart illustrating the flow of the replacement of an ejecting unit at the time of checking.
Figures 7, 8:
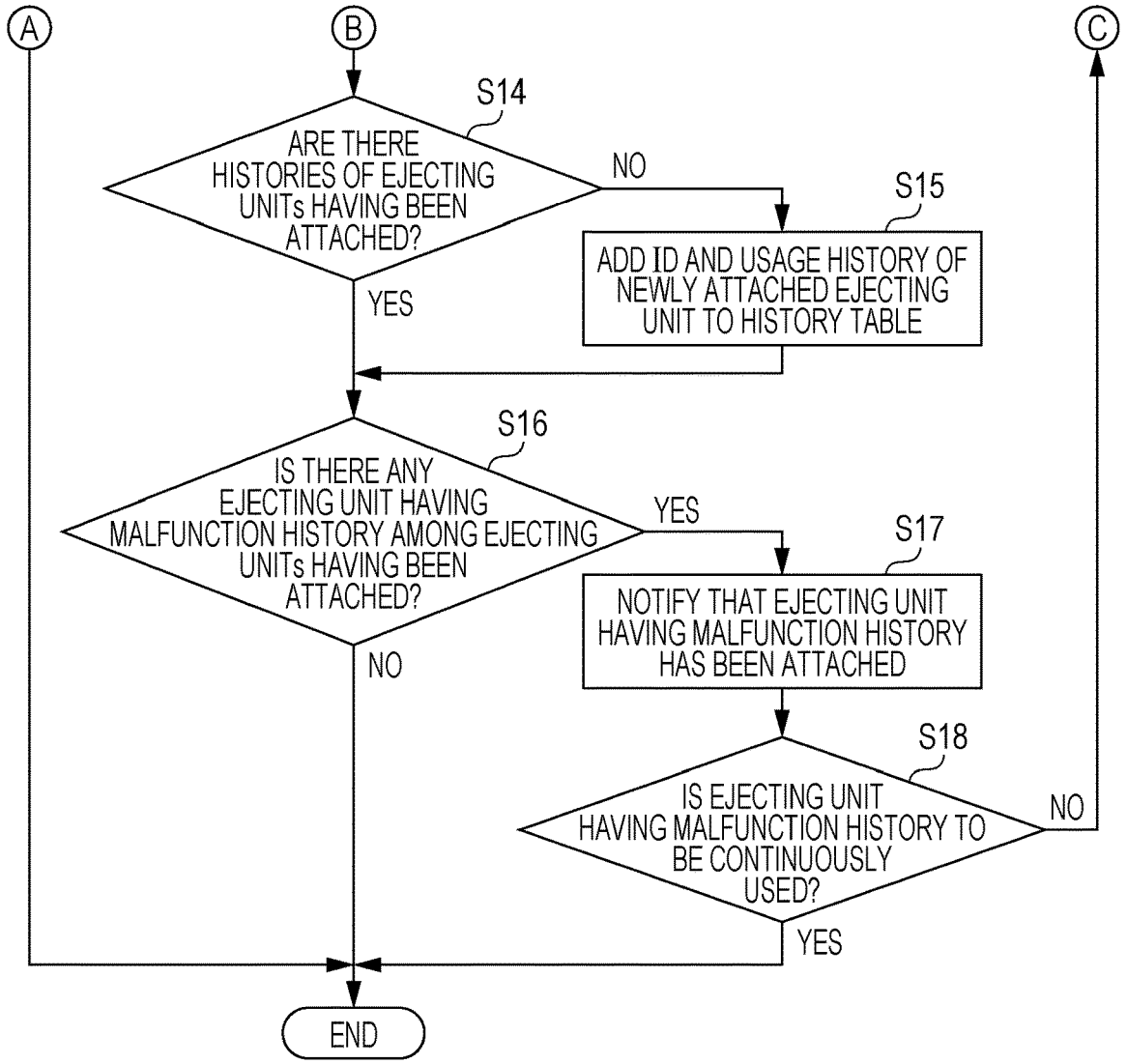
FIG. 7 is a flowchart illustrating a flow of the replacement of an ejecting unit at the time of checking.
FIG. 8 is a table illustrating an example of a history table for ejecting units.

First, the replacement operation for an ejecting unit 7 after the checking of the nozzles by the nozzle checking mechanism 21 will be described below. FIGS. 6 and 7 are flowcharts illustrating the flow from the checking of the nozzles to the replacement of the ejecting unit 7. First, the nozzles of the ejecting units 7, which are attached to the recording head 2, are checked by the nozzle checking mechanism 21 (step S1), and thereby, it is determined whether or not there is any defective nozzle (step S2). Here, the checking of the nozzles is performed at timing points, that is, for example, before the start of a printing operation, at predetermined intervals, after the power-on of the printer 1, and at any other timing point. When no defective nozzle has been discovered (in other words, detected) in any of the ejecting units 7 in the checking of the nozzles (in the case of "NO" in step S2), none of the ejecting units 7 is replaced and the process flow is terminated. When one or more defective nozzles have been discovered in an ejecting unit 7 in the checking of the nozzles (in the case of "YES" in step S2), it is determined whether or not the replacement of the relevant ejecting unit 7 is necessary (step S3). For example, when the number of defective nozzles in the relevant ejecting unit 7 is smaller than a predetermined number, it is determined that the replacement of the relevant ejecting unit 7 is unnecessary because the possibility that the defective nozzles are recovered by cleaning operation is high. In this case (in the case of "NO" in step S3), for example, the cleaning operation that causes ink to be forcibly ejected from the nozzles using a pump or the like in a state in which the nozzles are sealed by an unillustrated cap or the like is performed (step S4), and then, the nozzle checking is performed again (step S1).

In contrast, for example, when the number of the defective nozzles in the relevant ejecting unit 7 is larger than the predetermined number; when one or more defective nozzles have been discovered in the recheck of the nozzles (steps S1 and S2) after the cleaning operation has been repeated a plurality of times; or in any other similar case, it is determined that the replacement of the relevant ejecting unit 7 is necessary because the possibility that the one or more nozzles are recovered by the cleaning operation is low. That is, the malfunction of the relevant ejecting unit 7 has been detected. In this case (in the case of "YES" in step S3), the ID of the relevant ejecting unit 7, which has a malfunction and has become a replacement target, is specified, and the control device 26 stores the relevant ID into the storage device 27 as a replacement target ID (namely, replacement target identification information). In the present embodiment, the content of a malfunction (which corresponds to a piece of malfunction information in the invention), such as the number of defective nozzles, piezoelectric-elements' deteriorations, or the like, is stored, together with the relevant ID, into the storage device 27, as a portion of a history table (step S5). That is, the ID and the content of the malfunction are stored into the storage device 27 in such a way as to be associated with each other. FIG. 8 is an example of the history table stored in the storage device 27, and individual pieces of information in this history table are pieces of history data. Here, in FIG. 8, the ID of each of the ejecting units 7 is represented by a two digit number for the convenience of description. In the present embodiment, the IDs and the contents of malfunctions with respect to ejecting units 7 having been previously attached are also stored as pieces of history data in relation to corresponding malfunction histories. For example, ID 01 and ID 02 correspond to pieces of history data with respect to ejecting units 7 having been previously attached to the recording unit 2, and ID 03 to ID 10 correspond to pieces of history data with respect to ejecting units 7 that are currently attached to the recording unit 2. In this example, in ID 09, "multiple nozzle omissions", for which a plurality of defective nozzles has been discovered, are detected. That is, ID 09 corresponds to an ejecting unit 7 for which the replacement has been determined to be necessary.

Note that, in the present embodiment, a usage history indicating how many hours each ejecting unit 7 has been used (this usage history corresponding to a piece of usage history information in the invention) is also stored, together with a corresponding ID, in the storage device 27 as a piece of history data. The control device 26 acquires, from the history table, a piece of history data in relation to a usage history corresponding to the ID of each of the ejecting units 7 being in a state of being attached to the recording head 2, and corrects driving signals (driving voltages) for the each ejecting unit 7 based on the relevant usage history. Here, when the usage time of an ejecting unit 7 has exceeded a predetermined time, the piezoelectric elements thereof are likely to be in a deteriorated state, and thus, in step S3, it is also possible to determine that the replacement of the ejecting unit 7 is necessary.

Further, when the replacement of the relevant ejecting unit 7 has been determined to be necessary, the control device 26 notifies that the replacement of the relevant ejecting unit 7 is necessary (step S6), and the IDs of all of ejecting heads 7 being in a state of being attached to the recording head 2 before the replacement (in other words, the IDs of all of ejecting heads 7 that have been used in printing operations by the printer 1) are stored into the storage device 27 as pre-replacement IDs (namely, pre-replacement identification information). The notification that the replacement of the relevant ejecting unit 7 is necessary corresponds to displaying that the replacement is necessary on the display device 22, or transmitting, to the external device 30, an electric signal in relation to the notification and displaying that the replacement is necessary on a display portion of the external device 30. That is, the term "notify" in the present embodiment includes not only the case where the notification is made in a way that enables perceptions by human-beings, but also the case where the electric signal in relation to the notification is transmitted. Further, when this notification is made, the specific content of a malfunction can be also displayed. Based on this display, a user can determine whether or not the replacement of the relevant ejecting unit 7 is to be made. Here, it is also possible to, along with the above notification, shift the recording head 2 to a predetermined replacement position to thereby allow the state of the printer 1 to move to a state in which the user is able to easily replace the relevant ejecting unit 7. Here, the user performs a replacement work for replacing the relevant ejecting unit 7 when needed. Next, upon detection of the completion of the replacement work (that is, upon detection of an operation of the user for completing the replacement work, upon detection of the completion of the replacement work by means of a sensor, or upon detection of the completion of the replacement work in any other way), the control device 26 allows the ID acquisition devices 6 to read the IDs of all of ejecting units 7 being in a state of being attached to the recording head 2 as of then, and stores the IDs of the ejecting units 7, which are in a state of being attached to the recording head 2 after the replacement, into the storage device 27 as post-replacement IDs (namely, post-replacement identification information) (step S7).

Next, the control device 26 determines whether or not the replacement target ejecting unit 7 has been attached to the recording head 2 again, based on the identification information stored in the storage device 27. Specifically, the control device 26 determines whether or not the replacement target ejecting unit 7 (namely, the ejecting unit 7 having been determined to be in a malfunction state) has been attached to the recording head 2 again by determining whether or not there exists the replacement target ID, which has been specified in step S5, among the post-replacement IDs stored in the storage device 27 (step S8). When there exists the replacement target ID among the post-replacement IDs (in the case of "YES" in step S8), the control device 26 determines that the replacement target ejecting unit 7 has not been removed, but has been attached to the recording head 2 again, and notifies the display device 22 or the like of a state in which the ejecting unit 7 has not been replaced and the replacement target ejecting unit 7 is in a state of being attached to the recording head 2 again (step S9). Further, along with this notification, the control device 26 displays, on the display device 22 or the like, selection branches for allowing a user to determine whether or not the replacement target ejecting unit 7 is to be continuously used as it is (step S10). When it has been selected by an operation of the input device 23 or the like by the user that the replacement target ejecting unit 7 is not to be continuously used (in the case of "NO" in step S10), the control device 26 causes the process flow to return to step S6 to notify that the replacement of the relevant ejecting unit 7 is to be made.

In contrast, when the user selects an OK button, namely, a selection branch for allowing the replacement target ejecting unit 7 to be continuously used (in the case of "YES" in step S10), because, when washing operation, the replacement of parts, or the like has been performed on the replacement target ejecting unit 7 and thereby the malfunction has been eliminated, the degradation of the printing quality is unlikely to occur even when the relevant ejecting unit 7 is attached to the recording head 2 again and is continuously used, the control device 26 deletes a piece of history data in relation to a corresponding malfunction history from the history table stored in the storage device 27, or the control device 26 performs the nozzle checking again, and deletes a piece of history data in relation to a corresponding malfunction history when there exists no problem in the nozzle checking, and then allows the process flow to proceed to step S11. In step S8, in contrast, when there does not exist the replacement target ID among the post-replacement IDs (in the case of "NO" in step S8), the control device 26 determines that the replacement target ejecting unit 7 having been detached from the recording head 2 has not been attached to the recording head 2 again; appends information indicating the detachment in such a way that the information is associated with the ID of the replacement target ejecting unit 7, the ID being stored in the storage device 27, or temporally stores the ID of the ejecting unit 7 having been detached this time into another storage region; and then allows the process flow to proceed to step S11.

Next, in step S11, the control device 26 compares the pre-replacement IDs having been stored into the storage device 27 in step S6 with the post-replacement IDs having been stored into the storage device 27 in step S7 to determine whether or not there exists any ID that is among the pre-replacement IDs exclusive of the replacement target ID and that is not included in the post-replacement IDs so as to determine whether or not any of non-replacement target ejecting units 7 has been detached. In this way, it is possible to reduce a situation where any of the non-replacement target ejecting unit 7 is detached. When there does not exist any ID that is among the pre-replacement IDs exclusive of the replacement target ID and that is not included in the post-replacement IDs (in the case of "NO" in step S11), the control device 26 determines that none of the non-replacement target ejecting units 7 has been detached, and allows the process flow to proceed to step S14. In contrast, when there exists an ID that is among the pre-replacement IDs exclusive of the replacement target ID and that is not included in the post-replacement IDs (in the case of "YES" in step S11), the control device 26 determines that a non-replacement target ejecting unit 7 has been detached, and notifies the display device 22 or the like of a state in which the non-replacement target ejecting unit 7 has been detached (step S12). Further, along with this notification, selection branches that allow the user to determine whether or not the non-replacement target ejecting unit 7 is to remain detached are displayed on the display device 22 or the like (step S13). When the user selects a selection branch that does not allow the non-replacement target ejecting unit 7 to remain detached by operating the input device 23 or the like (in the case of "NO" in step S13), the control device 26 allows the process flow to return to step S6, and notifies that the replacement of the ejecting unit 7 is to be made. In contrast, when the user selects a selection branch that allows the non-replacement target ejecting unit 7 to remain detached by operating the input device 23 or the like (in the case of "YES" in step S13), the control device 26 appends information indicating that the non-replacement target ejecting unit 7 has been detached, to a corresponding ID stored in the storage device 27, or temporally stores the ID of the ejecting unit 7 having been detached this time into another storage region, and then allows the process flow to proceed to step S14.

Next, the control device 26 compares the post-replacement IDs, having been stored into the storage device 27 in step S7, with pieces of history data included in the history table stored in the storage device 27 to determine whether or not there exists any ID that is among the post-replacement IDs and that is not included in the pieces of history data so as to determine whether or not pieces of history data associated with all of ejecting units 7 that are currently in a state of being attached to the recording head 2 are stored in the history table of the storage device (step S14). When the IDs of all of the ejecting units 7 that are currently in a state of being attached to the recording head 2 are not stored in the history table of the storage device 27 (in the case of "NO" in step S14), that is, when a new ejecting unit 7 that has never been attached to the recording head 2 has been attached to the recording head 2, in step S15, the ID of the newly attached ejecting unit 7 is stored into the history table (in other words, a history list) of the storage device 27 as a piece of history data; the usage history of the relevant ejecting unit 7 is newly stored into the history table of the storage device 27; and the process flow proceeds to step S16. Further, in step S14, when the IDs of all of the ejecting units 7 that are currently being in a state of being attached to the recording head 2 are stored in the history table (in the case of "YES" in step S14), the IDs and the usage histories of all of the ejecting units 7 are already stored in the storage device 27, and thus, any ID is not newly stored into the storage device 27. In this case, in response to the usages of ejecting units 7, the usage histories of the ejecting units 7 are appropriately updated. In this way, the usage history is also stored together with a corresponding ID, thus enabling the driving signals for a corresponding ejecting unit 7 to be corrected using the relevant usage history. This correction of the driving signals using the usage history enables the ink to be ejected in a way appropriate to the usage history of the ejecting unit 7.

Next, the control device 26 determines whether or not any ejecting unit 7 having a malfunction history (a piece of malfunction information) is in a state of being attached to the recording head 2, based on the history table (the pieces of malfunction information) stored, together with the IDs, in the storage device 27. Specifically, the control device 26 determines whether or not there exists any ID that is among the post-replacement IDs and that coincides with one of IDs that are stored, together with the malfunction histories, in the storage device 27 (step S16). When there does not exist any ID that is among the post-replacement IDs and that coincides with one of the IDs that are stored, together with the malfunction histories, in the history table of the storage device 27 (in the case of "NO" in step S16), the control device 26 terminates the replacement operation. When there exists an ID that is among the post-replacement IDs and that coincides with one of the IDs that are stored, together with the malfunction histories, in the history table of the storage device 27 (in the case of "YES" in step S16), the control device 26 notifies the display device 22 or the like of a state in which the ejecting unit 7 having a malfunction history is currently in a state of being attached to the recording head (step S17). In this case, along with this notification, the specific content of a previous malfunction can be also displayed. Further, the control device 26 displays, on the display device 22 or the like, selection branches for allowing a user to determine whether or not the ejecting unit 7 having a malfunction history is to be used as it is (step S18). When the user selects a selection branch for allowing the ejecting unit 7 having a previous malfunction to be used as it is (in the case of "YES" in step S18), the control device 26 terminates the replacement operation. In this case as well, the control device 26 may delete the malfunction history from the history table, which is stored in the storage device 27. Further the control device 26 may perform the nozzle checking and then, when there is no problem, the control device 26 may delete the malfunction history. When the user selects a selection branch allowing the ejecting unit 7 having a previous history not to be used (in the case of "NO" in step S18), the control device 26 notifies that the replacement of the ejecting unit 7 is to be made again (the control device 26 allows the process flow to return to step S6).

Further, in the replacement operation for an ejecting unit 7 for which a malfunction has been detected in the checking of the nozzles, the operation performed in such a way as described above enables reduction of a situation where the relevant ejecting unit 7, which has been determined to be necessary to be detached from the printer 1 and be replaced due to its deterioration, its malfunction, or the like, is erroneously attached to the printer 1 again. As a result, the occurrence of a situation where the printing operation using an ejecting unit 7 being in a deteriorated state, a malfunction state, or any other similar state can be reduced, and thus, the degradation of the image quality of printed objects can be reduced. Further, upon detection of the malfunction of an ejecting unit 7, malfunction information (a malfunction history) in relation to the detected malfunction of the relevant ejecting unit 7 has been stored, together with its ID, into the storage device 27, and thus, after the replacement of the relevant ejecting unit 7, the IDs of ejecting units 7 that are in a state of being attached to the recording head 2 are acquired; it is determined whether or not the relevant IDs and pieces of malfunction information corresponding thereto are stored in the storage device 27; and when the malfunction information in relation to the relevant ejecting unit 7 is stored in the storage device 27, it is notified that the relevant ejecting unit 7 having a malfunction history is currently attached, thus enabling reduction of a situation where an ejecting unit 7 having previously malfunctioned is erroneously attached to the printer 1.

Figure 9:
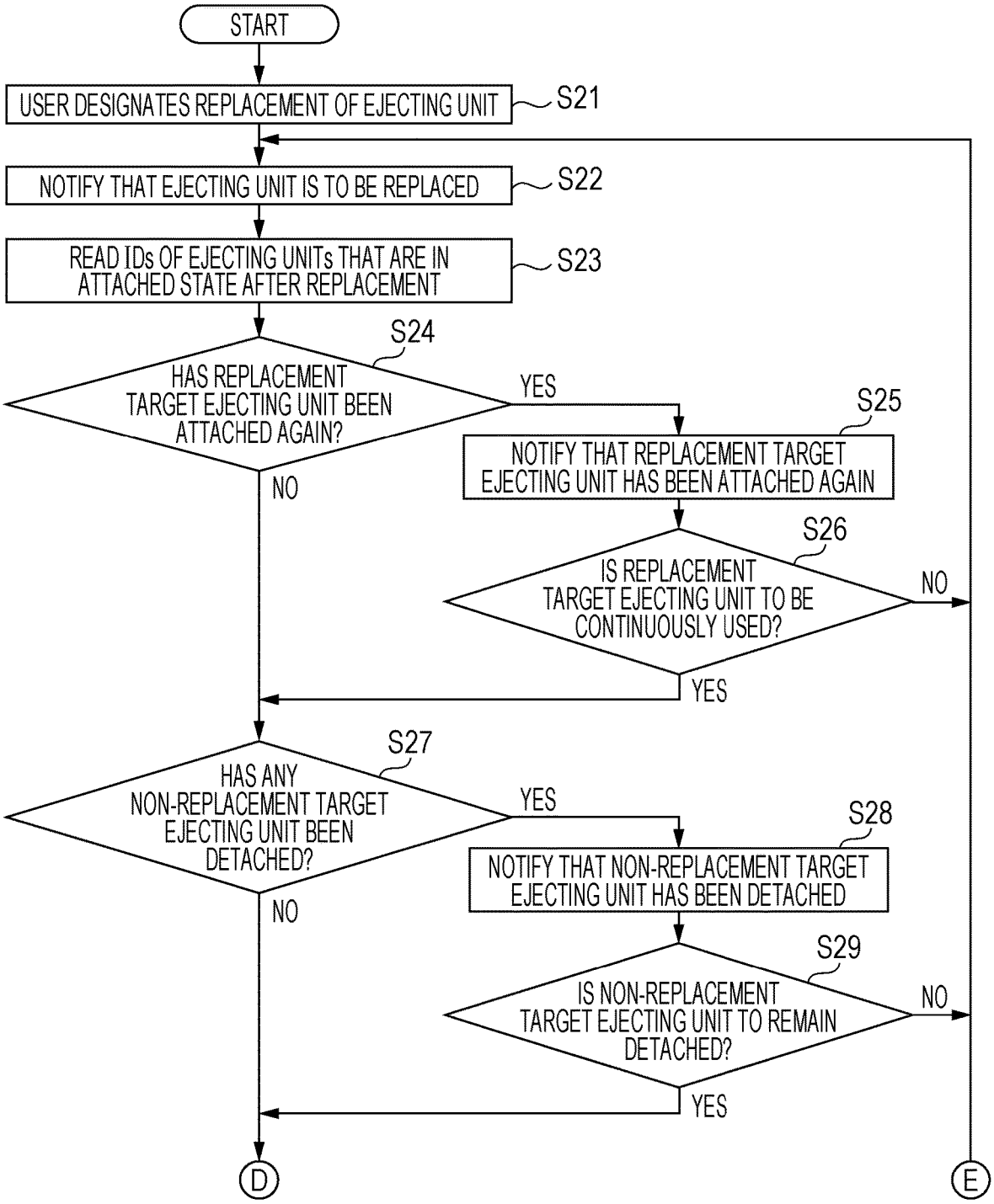
FIG. 9 is a flowchart illustrating a flow of the replacement of an ejecting unit in accordance with a designation of a user.
Figure 10:
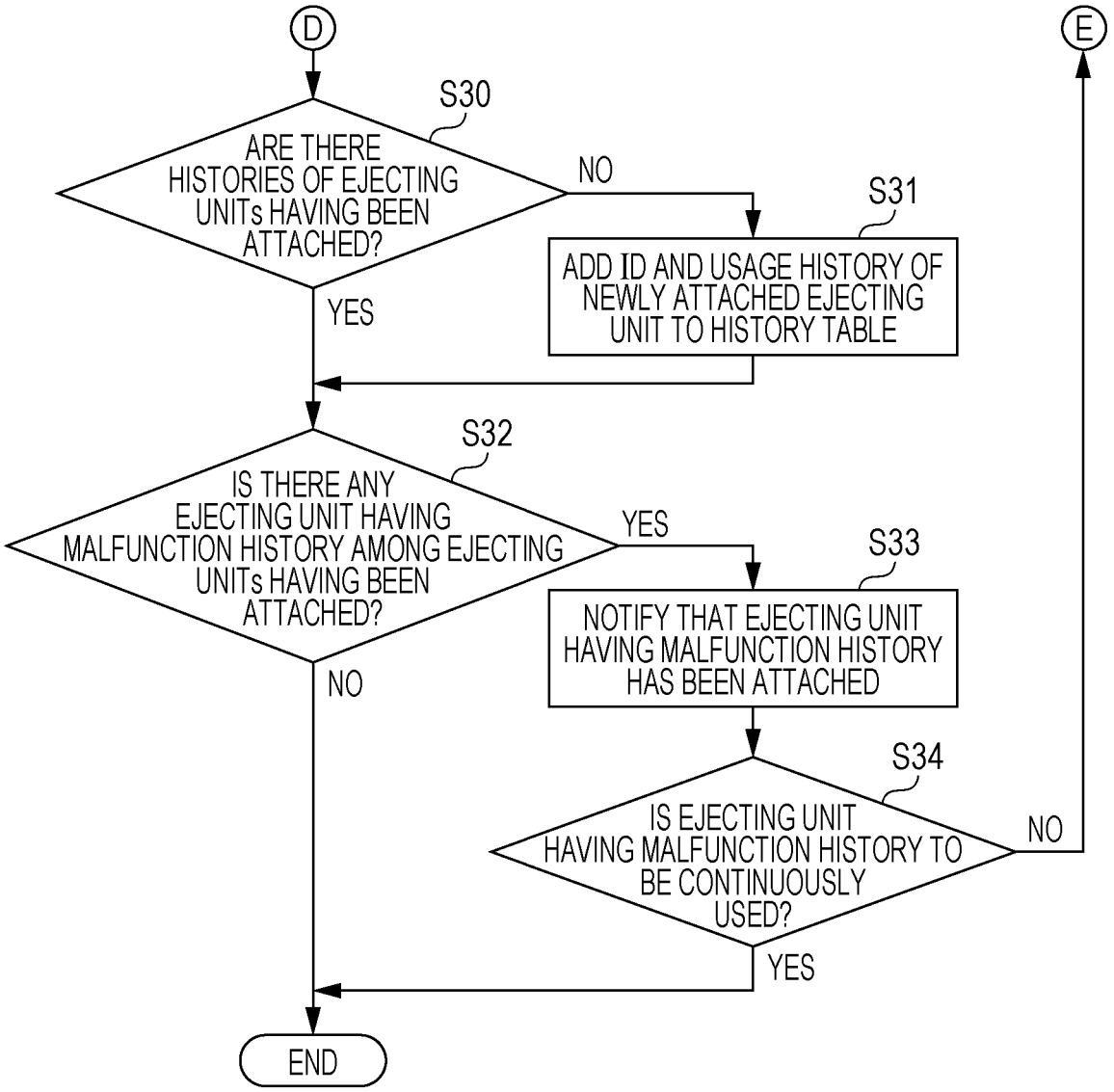
FIG. 10 is a flowchart illustrating a flow of the replacement of an ejecting unit in accordance with a designation of a user.

Next, replacement operation for an ejecting unit 7 on a user's designation basis will be described. FIGS. 9 and 10 are flowcharts illustrating the flow of the replacement of an ejecting unit 7 on a user's designation basis. First, when a user designates the replacement of a predetermined ejecting unit 7 by operating the input device 23 or the like (step S21), the control device 26 specifies the ID of the replacement target ejecting unit 7 having been designated, and stores the relevant ID into the storage device 27 as a replacement target ID (a piece of replacement target identification information). For example, the control device 26 appends, to an ID stored in the storage device 27, information indicating that the ID corresponds to a replacement target, or temporarily stores the ID of the replacement target ejecting unit 7, which is a replacement target, into another storage region. Note that, in this case, it is also possible to shift the recording head 2 to a predetermined replacement position to thereby allow the state of the printer 1 to move to a state in which the user is able to easily replace the relevant ejecting unit 7. Further, the control device 26 makes a notification in relation to the replacement of the ejecting unit 7 (step S22). For example, the control device 26 performs a display for prompting the replacement of the ejecting unit 7 on the display device 22 or the like.

Here, the user performs a replacement work for the ejecting unit 7 as needed. The contents of subsequent steps S23 to S34 are respectively the same as the contents of steps S7 to S18 described above, and thus, the description of steps S23 to S34 is omitted here.

In the replacement operation for an ejecting unit 7 on a user's designation basis as well, the operation performed in such a way as described above can reduce a situation where an ejecting unit 7 having been designated as a replacement target by a user and having a malfunction history is erroneously attached to the printer 1 again. As a result, the occurrence of a situation where the printing operation is performed using an ejecting unit 7 having been determined by a user to be in a deteriorated state, a malfunction state, or any other similar state can be reduced, and thus, the degradation of the image quality of printed objects can be reduced.

By the way, in the above embodiment, after the replacement of an ejecting unit 7, the IDs of ejecting units 7 that are in a state of being attached to the recording head 2 are acquired and it is determined whether or not there exists any ID that is among the relevant IDs and that is stored, together with a malfunction history, in the storage device 27, but the invention is not limited to this configuration. For example, a configuration in which, after the power-on of the printer 1, the IDs of ejecting units 7 that are in a state of being attached to the recording head 2 are acquired and it is determined whether or not there exists any ID that is among the relevant IDs and that is stored together with a malfunction history in the storage device 27 may be employed. Further, in this configuration, when there exists an ID that is among the relevant IDs and that is stored together with a malfunction history of an ejecting unit 7 in the storage device 27, the control device 26 notifies that the ejecting unit 7 having a malfunction history is in an attached state. With this configuration, even when, during a state in which the power of the printer 1 is turned off, the replacement of an ejecting unit 7 has been made and an ejecting unit 7 having a malfunction history has been erroneously attached, the occurrence of a situation where the printing operation is performed using such an ejecting unit 7 being in a deteriorated state, a malfunction state, or any other similar state can be reduced. As a result, the degradation of the image quality of printed objects can be reduced.

Further, in the above embodiment, together with the IDs of ejecting units 7 having been previously attached to the recording head 2, the usage histories and the malfunction histories are stored in the storage device 27, but the invention is not limited to this configuration. A configuration in which at least the IDs of the ejecting units 7 are stored in the storage device 27 may be employed. When only the IDs are stored in the storage device 27, a configuration in which, upon determination of the malfunction of an ejecting unit 7 or upon designation of a replacement target ejecting unit 7 by a user, the ID of the replacement target ejecting unit 7 is once stored into the storage device 27, and then is deleted after the attachment of a new ejecting unit 7, the comparison of post-replacement IDs (pieces of post-replacement identification information) with pre-replacement IDs (pieces of pre-replacement identification information), the execution of a determination as to whether or not each of ejecting units 7 that are in an attached state has been erroneously attached (that is, after the execution of steps S7 to S18 described above, or after the execution of steps S23 to S34 described above) may be employed. Alternatively, a configuration in which, when the amount of pieces of data, such as the IDs, the usage histories, the malfunction histories, or the like, stored in the storage device 27 has reached a predetermined amount, or when the number of the IDs that are preserved has reached a predetermined number, or in any other similar case, these pieces of information may be sequentially deleted in order from the oldest piece of information may be employed.

Moreover, in the above embodiment, the storage device 27 is provided inside the printer 1, but the invention is not limited to this configuration. For example, a recording device may be provided in a server on a network, such as the Internet or the like, to which a printer is connected. In this case, a configuration in which a plurality of printers is connected to the relevant network and a history table is shared among the individual printers is also applicable. Further, in the above embodiment, the IDs on the ID labels 34 are optically read by the ID acquisition devices 6, but the invention is not limited to this configuration. For example, a configuration in which the IDs are stored in a non-volatile memory or the like that is provided in an ejecting unit, and the IDs are acquired from the non-volatile memory or the like in such a way as to, when the ejecting unit is attached to a recording head, allow an electric connection therebetween to be made can be also employed. In this case, a section that makes the electric connection corresponds to an identification information acquisition device in the invention.

Further, in the above embodiment, the printer 1 including the recording head 2 provided with a total of eight ejecting heads 7 is exemplified, but the invention is not limited to this configuration. The invention is applicable to any printer including a recording head to which at least one or more ejecting units are attached. Moreover, in the above embodiment, the printer 1 including a so-called line head in which the plurality of ejecting units 7 are arranged in the width direction of the recording paper 20 is exemplified, but the invention is not limited to this configuration. The invention is also applicable to a printer including a so-called serial head in which a recording head to which an ejecting unit is attached ejects ink while scanning (reciprocally moving) in an axis (a main-scanning axis) intersecting with the transport direction of recording paper (namely, a sub-scanning direction).

Further, in the above embodiment, the description has been made by exemplifying the ejecting unit 7, which ejects ink, as the liquid ejecting head, but the invention is applicable to other kinds of liquid ejecting heads. The invention is also applicable to, for example, a color material ejecting head for use in manufacturing color filters for a liquid crystal display and the like; an electrode material ejecting head for use in forming electrodes for an organic electro luminescence (EL) display, a face emitting display (FED), and the like; a live organic material ejecting head for use in manufacturing biochips (biochemical elements); and the like. In a color material ejecting head for a display manufacturing apparatus, solutions of individual red (R), green (G), and blue (B) color materials are ejected as a kind of liquid. Further, in the electrode material ejecting head for an electrode forming apparatus, electrode materials being in a liquid condition are ejected as a kind of liquid, and in the live organic material ejecting head for a chip manufacturing apparatus, solutions of live organic materials are ejected as a kind of liquid.

The entire disclosure of Japanese Patent Application No. 2018-055766, filed Mar. 23, 2018 is expressly incorporated by reference herein.

What is claimed is:

1. A liquid ejecting apparatus comprising:

a liquid ejecting head including nozzles through which liquid is ejected, and including an identification information specific to the liquid ejecting head;

an identification information acquisition device configured to acquire the identification information from the liquid ejecting head;

a storage device in which the identification information is stored; and a control device configured to, in a case in which, when a replacement for the liquid ejecting head is made in response to a notification that replacement of the liquid ejecting head is needed due to a potential malfunction in the liquid ejecting head, the liquid ejecting head being a replacement target that has been attached again during a replacement process, notify that the liquid ejecting head being the replacement target is in an attached state again, based on the identification information stored in the storage device.

2. The liquid ejecting apparatus according to claim 1, wherein the control device is configured to store in the storage device:

the identification information of the liquid-ejecting-head being the replacement target as a replacement target identification information; and the identification information of the liquid-ejecting-head in an attached state after a replacement as a post-replacement identification information, wherein the control device notifies that the liquid ejecting head being the replacement target is in the attached state again when the replacement target identification information exists among the post-replacement identification information.

3. The liquid ejecting apparatus according to claim 2, wherein the control device stores in the storage device the identification information of the liquid ejecting head designated by user as the replacement target, as the replacement target identification information.

4. The liquid ejecting apparatus according to claim 2, further comprising a detection device configured to detect a malfunction in the liquid ejecting head, wherein, when the detection device detects the malfunction of the liquid ejecting head, the control device stores in the storage device the identification information of the liquid ejecting head, for which the malfunction has been detected, as the replacement target identification information.

5. The liquid ejecting apparatus according to claim 1, further comprising a detection device configured to detect a malfunction in the liquid ejecting head, wherein, when the detection device detects the malfunction of the liquid ejecting head, the control device stores in the storage device a malfunction information in relation to the malfunction together with the identification information of the liquid ejecting head, for which the malfunction has been detected, and wherein, in a case in which, when the replacement for the liquid ejecting head is made, the liquid ejecting head having the identification information coinciding with the identification information stored, together with the malfunction information, in the storage device is in the attached state, the control device notifies that the liquid ejecting head having a malfunction history is in the attached state, based on the malfunction information stored, together with the identification information, in the storage device.

6. The liquid ejecting apparatus according to claim 5, wherein, after power-on of the liquid ejecting head, the control device acquires the identification information specific to the liquid ejecting head being in a attached state, and determines whether or not the malfunction information associated with the identification information of the liquid ejecting head being in the attached state is stored in the storage device, and wherein, when the control device determines that the malfunction information associated with the identification information of the liquid ejecting head being in the attached state is stored in the storage device, the control device notifies that the liquid ejecting head having the malfunction is in an attached state.

7. The liquid ejecting apparatus according to claim 1, wherein, in a case in which, when the replacement for the liquid ejecting head is made, the liquid ejecting head having the identification information not coinciding with the identification information stored in the storage device is in an attached state, the control device newly stores in the storage device a usage history information together with the identification information associated with the liquid ejecting head.

8. The liquid ejecting apparatus according to claim 1, wherein, in a case in which, when the replacement for the liquid ejecting head is made, a liquid ejecting head other than the liquid ejecting head being the replacement target is in the detached state, the control device notifies that the liquid ejecting head other than the liquid ejecting head being the replacement target is in a detached state, based on the identification information stored in the storage device.

9. A driving method for a liquid ejecting apparatus comprising a liquid ejecting head including nozzles through which liquid is ejected, and an identification information specific to the liquid ejecting head, the driving method comprising;

before a replacement for the liquid ejecting head in response to a notification that replacement of the liquid ejecting head is needed due to a potential malfunction in the liquid ejecting head, storing the identification information acquired from a replacement target liquid ejecting head, as a replacement target identification information;

after the replacement for the liquid ejecting head, storing the identification information acquired from the liquid ejecting head being in an attached state after the replacement, as a post-replacement identification information; and when the replacement target identification information is included in the post-replacement identification information, notifying that the liquid ejecting head being the replacement target is in an attached state again.

10. A liquid ejecting apparatus comprising:

a liquid ejecting head including nozzles through which liquid is ejected, and including an identification information specific to the liquid ejecting head;

an identification information acquisition device configured to acquire the identification information from the liquid ejecting head;

a storage device in which the identification information is stored; and a control device configured to, in a case in which, when a replacement for the liquid ejecting head is made in response to a designation of the liquid ejecting head which is designated as a replacement target by user, the liquid ejecting head being the replacement target that has been attached again during a replacement process, notify that the liquid ejecting head being the replacement target is in an attached state again, based on the identification information stored in the storage device.

11. The liquid ejecting apparatus according to claim 10, wherein the control device is configured to store in the storage device:

the identification information of the liquid-ejecting-head being the replacement target as a replacement target identification information; and the identification information of the liquid-ejecting-head in an attached state after a replacement as a post-replacement identification information, wherein the control device notifies that the liquid ejecting head being the replacement target is in the attached state again when the replacement target identification information exists among the post-replacement identification information.

12. The liquid ejecting apparatus according to claim 11, wherein the control device stores in the storage device the identification information of the liquid ejecting head designated by user as the replacement target, as the replacement target identification information.

13. The liquid ejecting apparatus according to claim 11, further comprising a detection device configured to detect a malfunction in the liquid ejecting head, wherein, when the detection device detects the malfunction of the liquid ejecting head, the control device stores in the storage device the identification information of the liquid ejecting head, for which the malfunction has been detected, as the replacement target identification information.

14. The liquid ejecting apparatus according to claim 10, further comprising a detection device configured to detect a malfunction in the liquid ejecting head, wherein, when the detection device detects the malfunction of the liquid ejecting head, the control device stores in the storage device a malfunction information in relation to the malfunction together with the identification information of the liquid ejecting head, for which the malfunction has been detected, and wherein, in a case in which, when the replacement for the liquid ejecting head is made, the liquid ejecting head having the identification information coinciding with the identification information stored, together with the malfunction information, in the storage device is in the attached state, the control device notifies that the liquid ejecting head having a malfunction history is in the attached state, based on the malfunction information stored, together with the identification information, in the storage device.

15. The liquid ejecting apparatus according to claim 14, wherein, after power-on of the liquid ejecting head, the control device acquires the identification information specific to the liquid ejecting head being in a attached state, and determines whether or not the malfunction information associated with the identification information of the liquid ejecting head being in the attached state is stored in the storage device, and wherein, when the control device determines that the malfunction information associated with the identification information of the liquid ejecting head being in the attached state is stored in the storage device, the control device notifies that the liquid ejecting head having the malfunction is in an attached state.

16. The liquid ejecting apparatus according to claim 10, wherein, in a case in which, when the replacement for the liquid ejecting head is made, the liquid ejecting head having the identification information not coinciding with the identification information stored in the storage device is in an attached state, the control device newly stores in the storage device a usage history information together with the identification information associated with the liquid ejecting head.

17. The liquid ejecting apparatus according to claim 10, wherein, in a case in which, when the replacement for the liquid ejecting head is made, a liquid ejecting head other than the liquid ejecting head being the replacement target is in the detached state, the control device notifies that the liquid ejecting head other than the liquid ejecting head being the replacement target is in a detached state, based on the identification information stored in the storage device.

* * * * *